US008328193B2

(12) United States Patent
Ninomiya

(10) Patent No.: US 8,328,193 B2
(45) Date of Patent: Dec. 11, 2012

(54) IMAGE FORMING APPARATUS

(75) Inventor: Kenji Ninomiya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 12/785,827

(22) Filed: May 24, 2010

(65) Prior Publication Data

US 2010/0301546 A1 Dec. 2, 2010

(30) Foreign Application Priority Data

May 29, 2009 (JP) ..... 2009-130469

(51) Int. Cl.
*B65H 5/02* (2006.01)

(52) U.S. Cl. ..... 271/272; 271/314

(58) Field of Classification Search ..... 271/272–274, 271/314, 245
See application file for complete search history.

(56) References Cited

U.S. PATENT DOCUMENTS

| | | | | |
|---|---|---|---|---|
| 6,011,948 | A * | 1/2000 | Amano et al. | 399/395 |
| 6,889,031 | B2 | 5/2005 | Tsuchida | |
| 7,300,055 | B2 * | 11/2007 | Mukai | 271/272 |
| 2006/0034649 | A1 | 2/2006 | Han et al. | |

FOREIGN PATENT DOCUMENTS

| | | | |
|---|---|---|---|
| CN | 1736725 | A | 2/2006 |
| JP | 03243551 | A * | 10/1991 |

OTHER PUBLICATIONS

Notification of the First Office Action, dated Apr. 12, 2012, issued by the State Intellectual Property Office of the People's Republic of China, in Chinese Patent Application No. 201010189164.5.

* cited by examiner

*Primary Examiner* — Michael McCullough
(74) *Attorney, Agent, or Firm* — Fitzpatrick, Cella, Harper & Scinto

(57) ABSTRACT

An image forming apparatus has a pair of registration rollers which conveys a sheet to an image forming portion. The pair of registration rollers includes a first registration roller, which is fixed to a registration roller shaft and includes first and second registration roller rubbers formed of an elastic body and third to sixth registration roller rubbers, and a second registration roller includes first to sixth rollers in press contact with the registration roller rubbers of the first registration roller. The press contact portions between the registration roller rubbers of the first registration roller and the first to sixth rollers of the second registration roller are different in length in a sheet conveying direction.

6 Claims, 11 Drawing Sheets

IMAGE FORMING APPARATUS

BACKGROUND OF THE INVENTION

1. Field of the Invention

The present invention relates to an image forming apparatus, and particularly relates to a constitution of a pair of sheet conveying rollers provided in a sheet conveying portion.

2. Description of the Related Art

In the prior art, an image forming apparatus including a printer, a copying machine, and a FAX generally includes a registration portion for use in correction of skew feeding of a sheet conveyed to an image forming portion and positional alignment between an image formed in the image forming portion and a sheet. As such a registration portion, there is one which corrects the skew feeding of a sheet by means of a pair of registration rollers and aligns the positions of an image formed in the image forming portion and a sheet (see, U.S. Pat. No. 6,889,031). In the registration portion including the pair of registration rollers, first, the front end of a sheet, conveyed by a pair of conveying rollers on the upstream side, is butted against a nip of the pair of stopped registration rollers, whereby the front end of the sheet is follows the nip line of the pair of registration rollers, and the skew feeding of the sheet is corrected. Then, a timing of starting the rotation of the pair of registration rollers is controlled, whereby the positional alignment between the image formed in the image forming portion and the sheet are performed.

In the prior art image forming apparatus including the registration portion, the sheet subjected to the skew feeding correction is conveyed to the image forming portion by the rotation of the pair of registration rollers; however, at that time, the rear end of the sheet first passes through a nip of the pair of conveying rollers of upstream and thereafter to pass through a nip of the pair of registration rollers. When the rear end of a sheet passes through the nip of the pair of conveying rollers, which is a pair of sheet conveying rollers, and the nip of registration roller pair, an acceleration occurs in the sheet. The velocity of conveying the sheet is varied upon the occurrence of the acceleration in the sheet. Especially, in a case of using a thick and stiff sheet such as cardboard, in order to stably convey the sheet without causing a slip of the sheet, a conveying force from a strong conveying nip is required. However, the stronger the conveying nip, the larger an impact that occurs when the sheet passes through the nip. The variation of the sheet conveying velocity may cause a deviation of an image formed on a sheet in an image forming portion.

Thus, in view of the above problems, the present invention provides an image forming apparatus which can suppress a variation of a velocity of conveying a sheet that occurs when the sheet passes through a pair of sheet conveying rollers.

SUMMARY OF THE INVENTION

An image forming apparatus according to the present invention includes: a pair of sheet conveying rollers which conveys a sheet to an image forming portion which forms an image on the sheet, wherein the pair of sheet conveying rollers includes a driving roller including a plurality of roller portions in the axial direction, and a driven roller including, in the axial direction, a plurality of driven roller portions respectively in press contact with the plurality of roller portions, the plurality of roller portions and the plurality of driven roller portions constitute a plurality of a pair of rollers, and the plurality of the pair of rollers are different in length along a sheet conveying direction of a press contact portion between the roller portion and the driven roller portion.

According to the present invention, when a sheet passes through a pair of sheet conveying rollers, the magnitude of acceleration applied to the sheet is reduced, whereby a variation of a sheet conveying velocity that occurs when the sheet passes through the pair of sheet conveying rollers can be suppressed.

Further features of the present invention will become apparent from the following description of exemplary embodiments with reference to the attached drawings.

DESCRIPTION OF THE EMBODIMENTS

Figure 1:
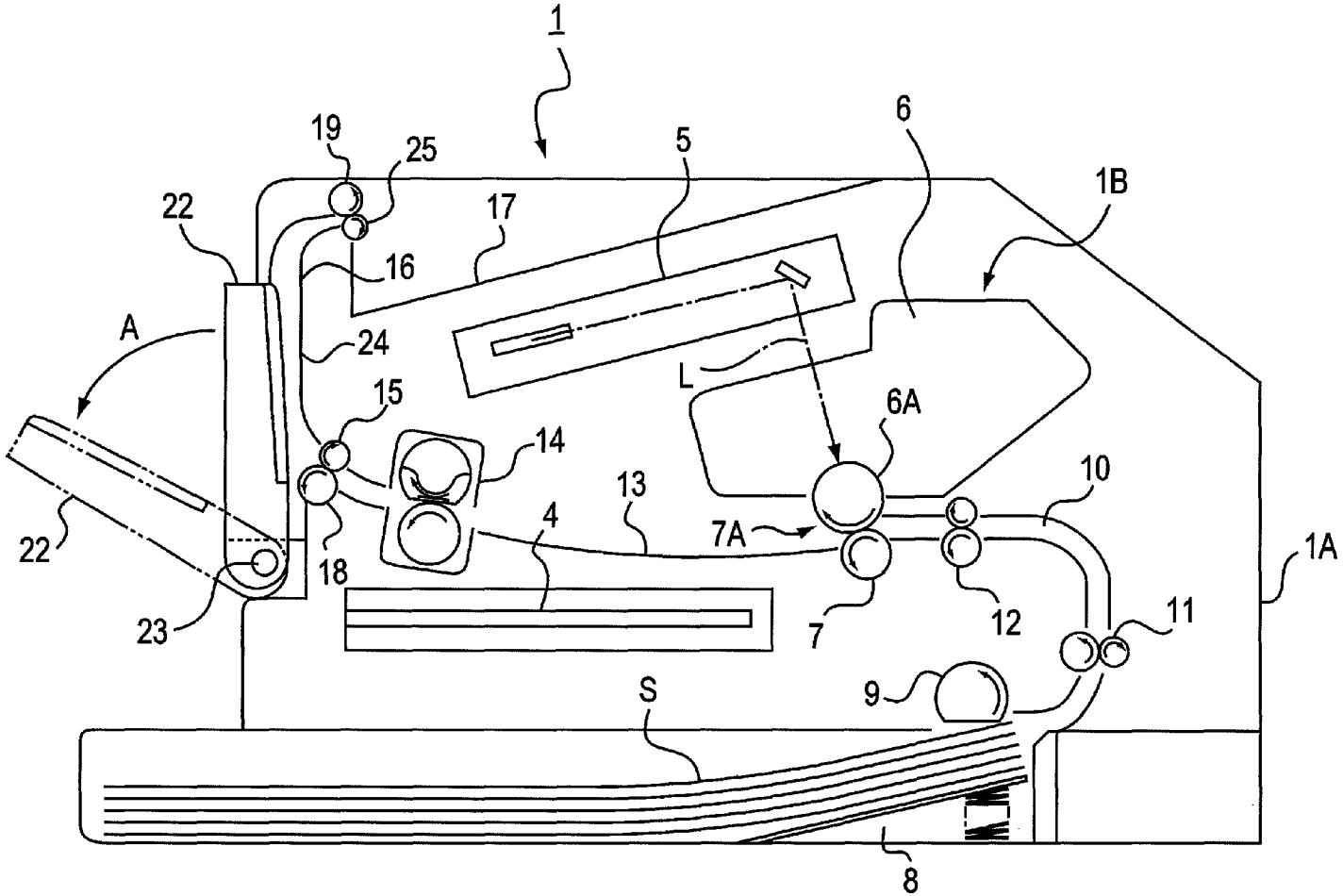
FIG. 1 is a view illustrating a schematic constitution of a laser beam printer which is an example of an image forming apparatus according a first embodiment of the present invention.

Hereinafter, embodiments of the present invention will be described in detail with reference to the drawings. FIG. 1 is a view showing a schematic constitution of a laser beam printer which is an example of an image forming apparatus according a first embodiment of the present invention. In FIG. 1, a laser printer 1 includes a printer body 1A and an image forming portion 1B. When the laser printer 1 receives information from external information equipment (not shown) such as a personal computer and a word processor, a video controller board 4 first creates an image signal based on the information. Thereafter, a laser scanner 5 irradiates a laser beam L, corresponding to the image signal created in the video controller board 4, onto a photosensitive drum 6A rotating in a clockwise direction. According to this constitution, an electrostatic latent image is formed on the photosensitive drum 6A.

In FIG. 1, a process unit 6 includes the photosensitive drum 6A, a charger (not shown) which electrostatically charges the surface of the photosensitive drum to predetermined polarity and potential uniformly, a toner development device (not shown), a cleaner (not shown). After the formation of the electrostatic latent image on the photosensitive drum 6A, the electrostatic latent image is made visible as a toner image in sequence with toner supplied from a development device (not shown) provided in the process unit 6. Thereafter, the toner image is conveyed to a transfer portion 7A including the photosensitive drum 6A and a transfer roller 7.

In parallel with the toner image forming operation, the topmost sheet of sheets S loaded and contained in a sheet cassette 8 is fed in sequence to a feeding path 10 by a semicircular feeding roller 9 rotating one revolution in a counter clockwise direction. Thereafter, the sheet is conveyed to a registration roller pair 12 stopping its rotation by a conveying roller 11. When the sheet S arrives at the pair of registration rollers 12, the front end of the sheet S is butted against a nip of the pair of registration rollers 12, and thereafter, the conveying roller 11 further conveys the sheet S until a predetermined loop is formed, whereby the skew feeding is corrected. The sheet S after the skew feeding correction is conveyed to the transfer portion 7A by the pair of registration rollers 12 starting the rotation with the timing of positional alignment with the toner image on the photosensitive drum. Thereafter, in the transfer portion 7A, the toner image on the photosensitive drum 6A is transferred onto the surface of the sheet S by the transfer roller 7. Then, the sheet S transferred with the toner image passes through a conveying guide 13 to be conveyed to a fixing device 14, and, thus, to be heated and pressurized in the fixing device 14, whereby the transferred toner image is fixed onto the sheet S.

When the sheet S fixed with the toner image is placed on a face-down discharge tray 17 provided in the upper portion of the printer body 1A so that the printed surface of the sheet S is directed downward (face-down placement), the sheet S enters into a conveying path including a conveying surface 16 and a face-up tray 22 facing the conveying surface 16. Thereafter, the sheet S is discharged onto the face-down discharge tray 17 by a face-down discharge roller 19, including a driving source (not shown), and a driven roller 25 rotated in accordance with the rotation of the face-down discharge roller 19 while being in press contact with the face-down discharge roller 19. When the sheet S is placed on the face-up tray 22 so that the printed surface is directed upward (face-up placement), the face-up tray 22 is previously opened at the rotation center 23 as a fulcrum, as shown by the arrow A. Then, by means of a face-up roller 18, including a driving source (not shown), and a roller 15 rotated in accordance with the rotation of the face-up roller 18 while being in press contact with the face-up roller 18, the sheet S is discharged onto the face-up tray 22 so that the printed surface is directed upward. In the present embodiment, the sheet is conveyed on a so-called center basis so that the center in the direction crosswise to the sheet conveying direction of a sheet conveying surface of the sheet conveying path and the center in the width direction crosswise to the sheet conveying direction are corresponded to each other.

Figure 2:
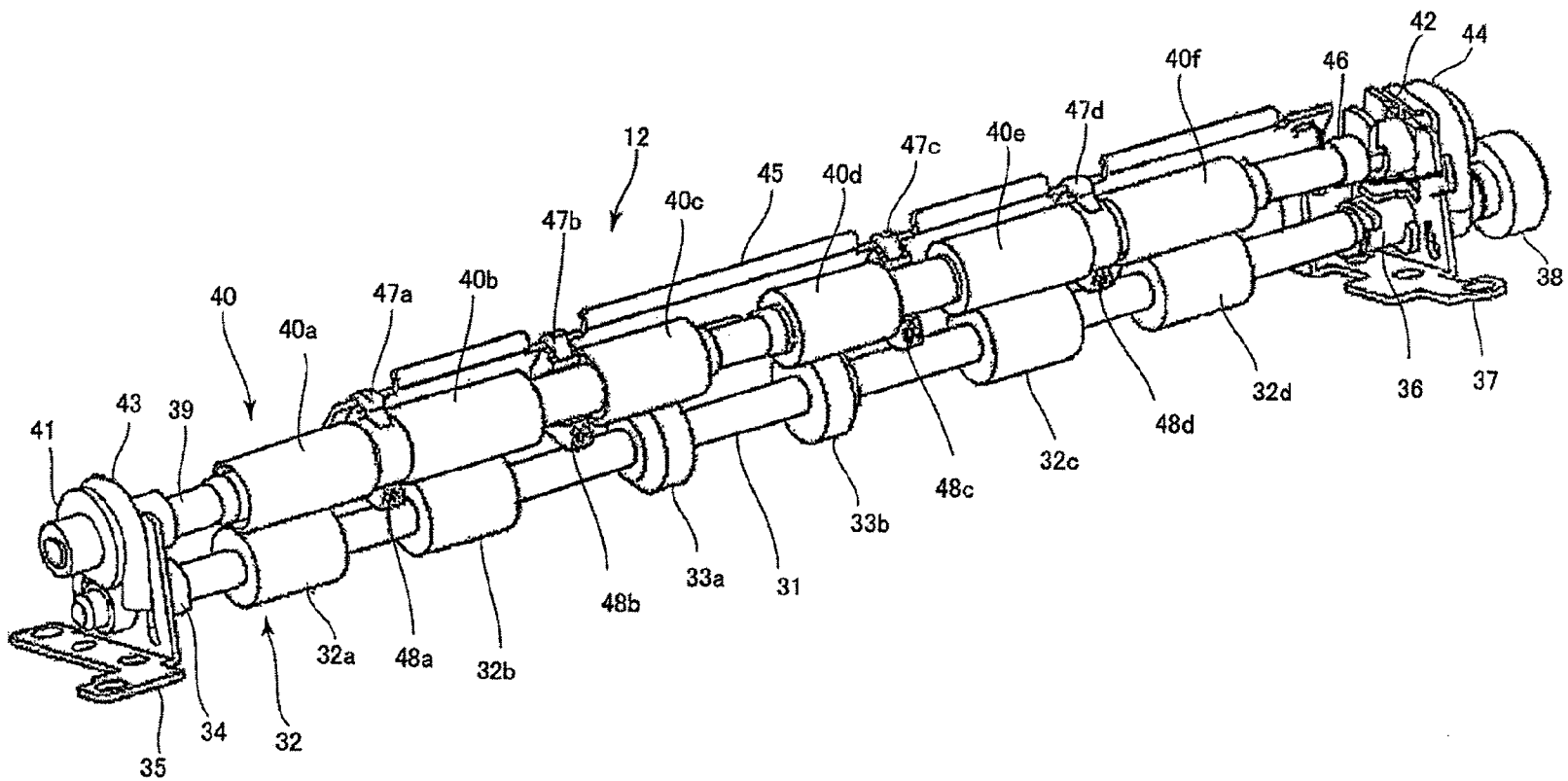
FIG. 2 is a perspective view of a pair of registration rollers including a registration portion provided in the laser beam printer.

FIG. 2 is a perspective view of the pair of registration rollers 12 including a registration portion which is a sheet conveying portion according to the present embodiment. As shown in FIG. 2, the pair of registration rollers 12 which is a pair of sheet conveying rollers includes a registration roller 32 which is a driving roller and a registration driven roller 40 which is a driven roller portion. The registration roller 32 includes first and second registration roller rubbers 33*a* and 33*b* which include a first roller portion fixed to a registration roller shaft 31 so as to be provided separately from the center of the registration roller shaft 31 to the left and right sides of the registration roller shaft 31. The first and second registration roller rubbers 33*a* and 33*b* formed of rubber (an elastic body) are disposed (supported) at the center in the axial direction of the registration roller shaft 31 in a symmetrical manner with respect to the center of the registration roller shaft 31 in the width direction crosswise to the sheet conveying direction. The registration roller 32 includes third to sixth registration roller rubbers 32*a* to 32*d* which include two (a plurality of) second roller portions. The third and fourth registration roller rubbers 32*a* and 32*b* are disposed on the first registration roller rubber 33*a* side in the axial direction, and the fifth and sixth registration roller rubbers 32*c* and 32*d* are disposed on the second registration roller rubber 33*b* side in the axial direction. The third to sixth registration roller rubbers 32*a* to 32*d* have different shapes from the first and second registration roller rubbers 33*a* and 33*b*. The registration roller shaft 31 is rotatably held by a left side plate 35 and a right side plate 37, provided in the printer body, through a left bearing 34 and a right bearing 36. The registration roller shaft 31 has a registration roller gear 38 attached to its end, and the registration roller gear 38 receives a driving force transmitted from a driving source (not shown).

The registration driven roller 40 includes first to sixth tubular rollers 40*a* to 40*f* which are a plurality of driven roller portions rotatably supported by a roller shaft 39. The roller shaft 39 is held by the left and right side plates 35 and 37 through a left roller bearing 41 and a right roller bearing 42 so as to be movable in the up and down directions and biased toward the registration roller by left and right springs 43 and 44 through the left and right roller bearings 41 and 42. According to this constitution, the first, second, fifth, and sixth rollers 40*a*, 40*b*, 40*e*, and 40*f* including a second driven roller portion are in press contact with the third to sixth registration roller rubbers 32*a* to 32*d*. Meanwhile, the third and fourth rollers 40*c* and 40*d* including a second driven roller portion are in press contact with the first and second registration roller rubbers 33*a* and 33*b*. The registration roller 40 is rotated in accordance with the rotation of the registration roller 32.

The registration roller 32 is a roller for use in the feeding of a sheet to the transfer portion 7A including the photosensitive drum 6A and the transfer roller 7. Therefore, the registration roller 32 is required to have such a constitution that the sheet can be conveyed at a predetermined sheet conveying velocity without being affected by a difference in feeding velocity due to variation in roller diameter, the skew feeding due to a variation in left and right velocities, and a difference in required conveying force based on a difference in the curling, irregularities, waviness, and thickness of a sheet. Thus, in the present embodiment, the registration roller 32 has high roller hardness (roller rubber hardness) of approximately 80° to 90°, so that the variation in roller diameter is prevented when the outer diameter is polished. The left and right springs 43 and 44 have a high spring pressure of 0.1 N to 0.15 N, whereby the conveyance is stabilized, and an image deviation due to a variation in the sheet conveying velocity is prevented.

Figure 3:
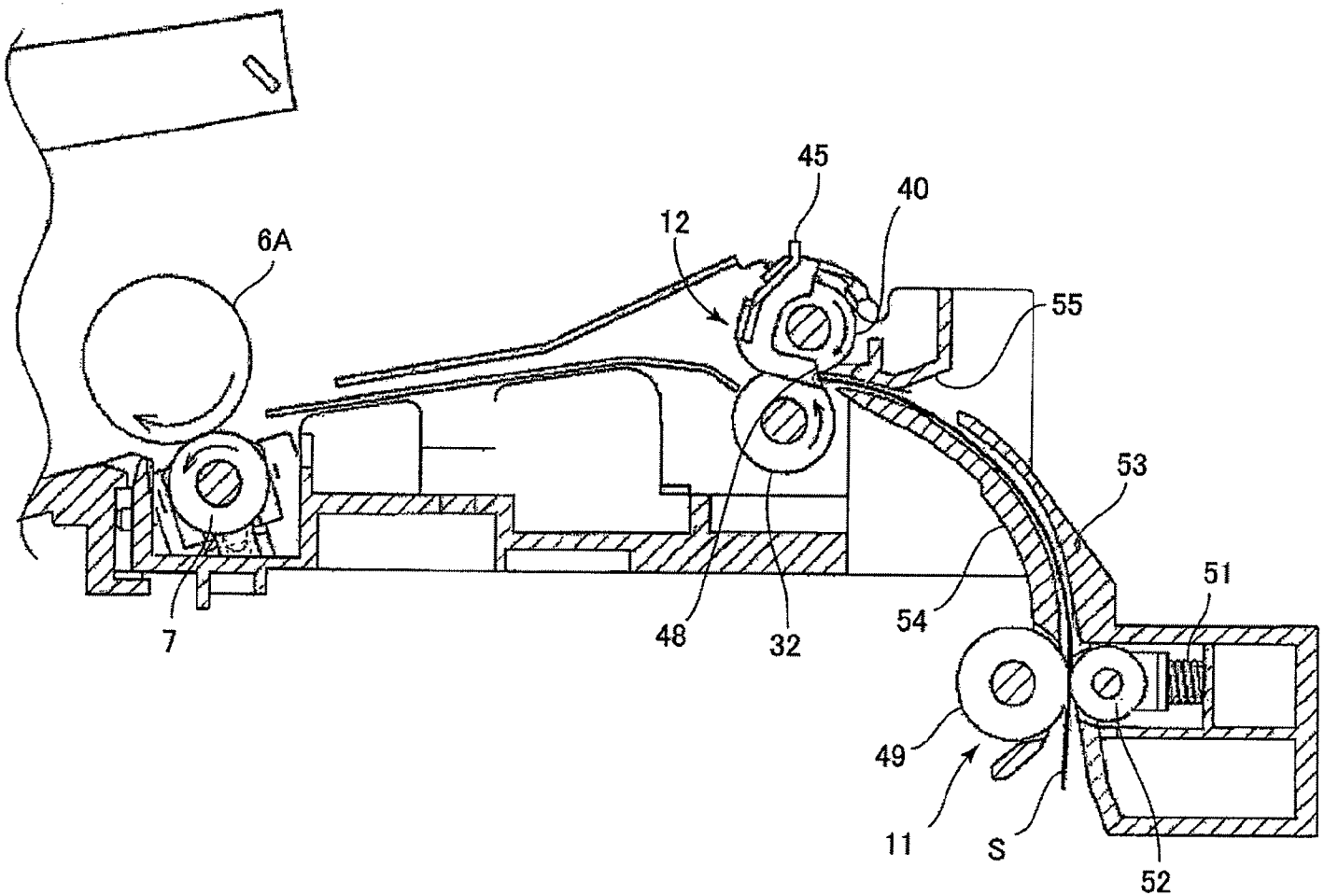
FIG. 3 is a view for describing a constitution of the pair of registration rollers and a conveying roller provided in the laser beam printer.

A registration shutter 45 which is a skew feeding correction member is rotatably held by the roller shaft 39, and registration matching members 47 (47*a* to 47*d*) including butting faces 48 (48*a* to 48*d*) are attached to the registration shutter 45. The registration shutter 45 is biased and held by a shutter spring 46 so that, as shown in FIG. 3, the butting face 48 is protruded, by a constant spring pressure, toward the upstream side in the sheet conveying direction relative to the nip between the registration roller 32 and the registration driven roller 40. According to this constitution, when the sheet travels toward the pair of registration rollers 12, the sheet is abutted against the registration shutter 45, biased in the direction opposite to the sheet conveying direction, on the upstream in the sheet conveying direction of the pair of registration rollers 12, and the skew feeding of the sheet is corrected. Thereafter, the registration shutter 45 is pressed by the sheet after the skew feeding correction and swings against the biasing force.

As shown in FIG. 3, the pair of conveying rollers 11 includes a conveying roller 49 and a conveying driven roller 52. The conveying roller 49 receives a drive force transmitted from a driving source (not shown) to be rotated in the arrow direction. The conveying driven roller 52 is brought into press contact with the conveying roller 49 by a spring 51 and rotated in accordance with the rotation of the conveying roller 49. The sheet S is conveyed toward the pair of registration rollers 12 by the pair of conveying rollers 11. The sheet S conveyed by the pair of conveying rollers 11 is then guided by conveyance guides 53 to 55, and the front end is butted against the butting face 48 of the registration shutter 45 to follow the butting face 48 of the registration shutter 45. According to this constitution, even when the sheet S is conveyed while being inclined, the skew feeding of the sheet S is corrected.

Figure 4A:
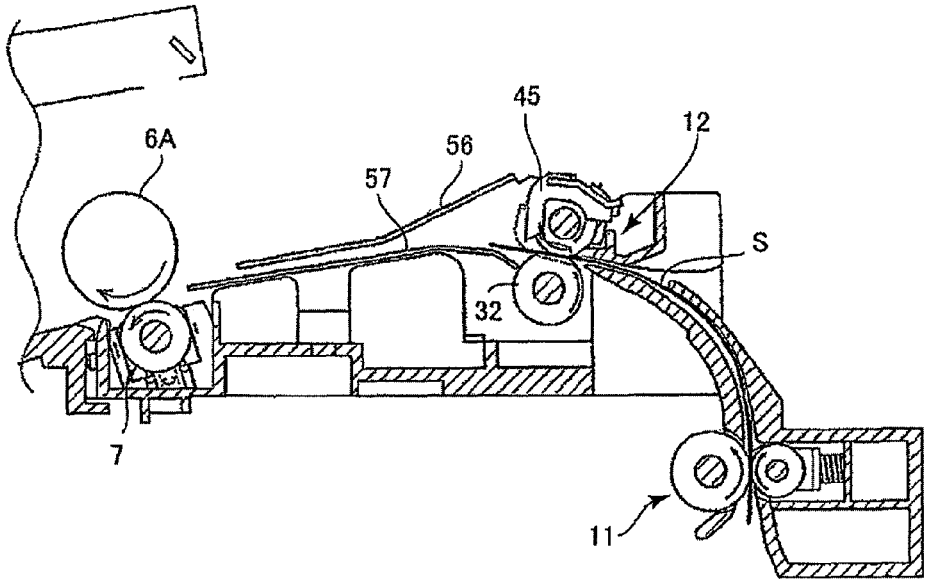
FIGS. 4A and 4B are views for describing a sheet conveying operation by the pair of registration rollers and the conveying roller.
Figure 4B:
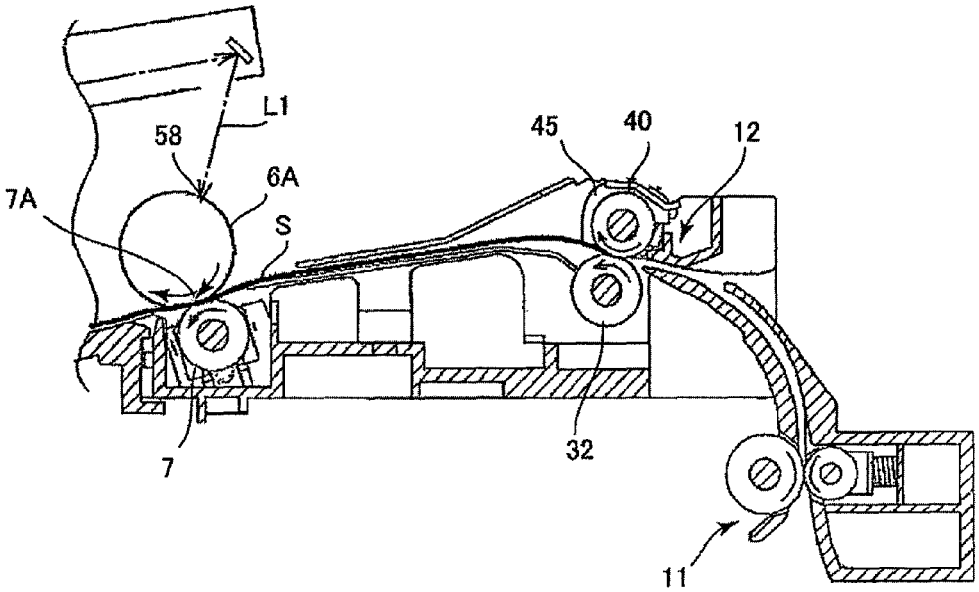

After the front end of the sheet S follows the butting face 48 of the registration shutter 45, the sheet S is further conveyed by the pair of conveying rollers 11. The sheet S, as shown in FIG. 4A, overcomes the spring force of the spring 51 to rotate the registration shutter 45 in the clockwise direction and is fed into the nip between the rotating registration roller 32 and the registration driven roller 40 so as to follow the butting face 48 of the registration shutter 45. The sheet S fed into the nip between the rotating registration roller 32 and the registration driven roller 40 is guided by a transfer upper guide 56 and a transfer lower guide 57 and, as shown in FIG. 4B, conveyed to the transfer portion 7A, including the photosensitive drum 6A and the transfer roller 7, by the registration roller 32. The photosensitive drum 6A rotating in the clockwise direction includes thereon an irradiated portion 58 exposed to a laser beam L1, and a latent image is always formed at the irradiated portion 58. After development of the latent image, a toner image is transferred onto the sheet S in the transfer portion 7A.

Figure 5:
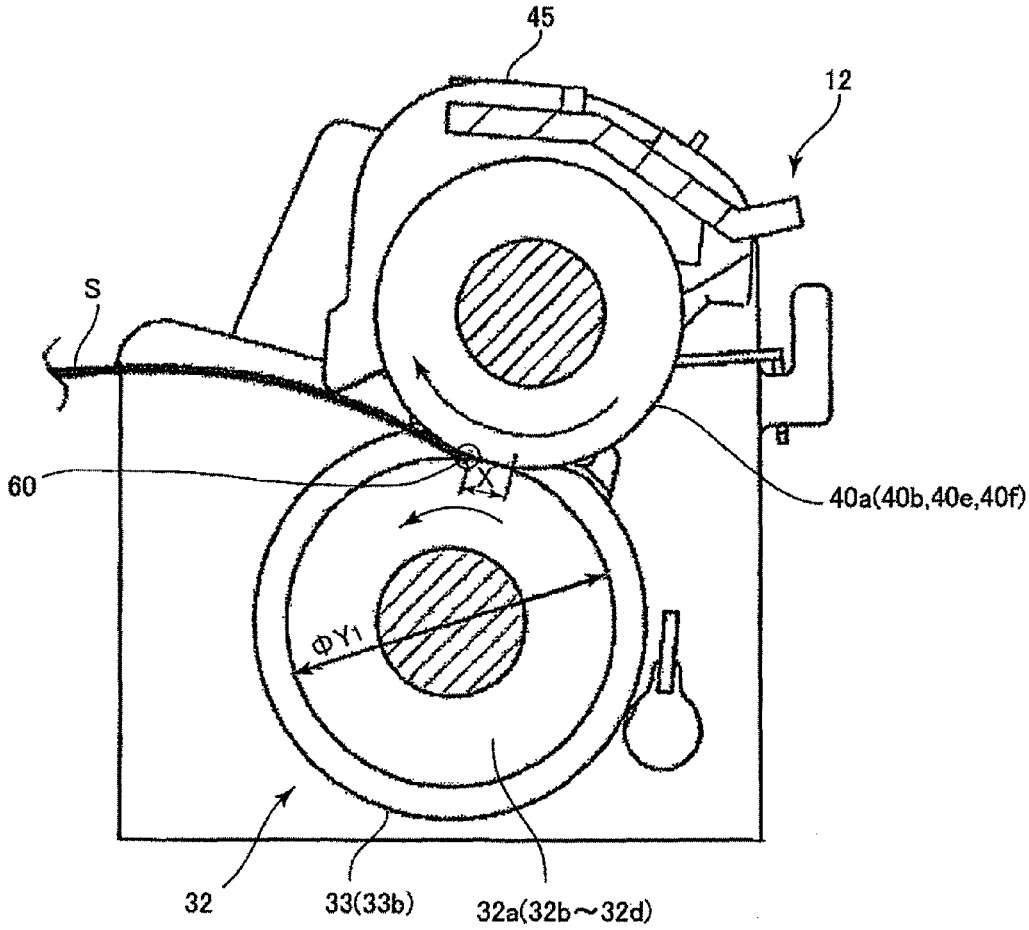
FIG. 5 is a view illustrating a state that the rear end of a sheet passes through the end side of the pair of registration rollers.

FIG. 5 shows a state that the rear end of the sheet S, which has reached the transfer portion, passes through the nip between the registration roller 32 and the registration driven roller 40. In FIG. 5, the registration roller 32 rotates in the counter clockwise direction, and the registration driven roller 40 in press contact with the registration roller 32 rotates in the clockwise direction in accordance with the rotation of the registration roller 32. By virtue of the conveyance of the sheet S, the registration shutter 45 is in a state of being pushed up in the clockwise direction. In FIG. 5, a nip width X1 is a width (length) in the sheet conveying direction of a nip which is a press contact portion between the third to sixth registration roller rubbers 32*a* to 32*d* of the registration roller 32 and the first, second, fifth, and sixth registration rollers 40*a*, 40*b*, 40*e*, and 40*f*. Namely, the nip width X1 is a nip width of the press contact portions of a plurality of a pair of rollers, formed by the press contact between the third to sixth registration roller rubbers 32*a* to 32*d* and the first, second, fifth, and sixth registration rollers 40*a*, 40*b*, 40*e*, and 40*f*. The sheet S passes through a nip pass-through portion 60. Y1 represents the outer diameters of the third to sixth registration roller rubbers 32*a* to 32*d*. The third to sixth registration roller rubbers 32*a* to 32*d* are formed of hard rubber for stable conveyance purposes, and the hardness Z1 is set to approximately 80° to 90°.

Figure 6:
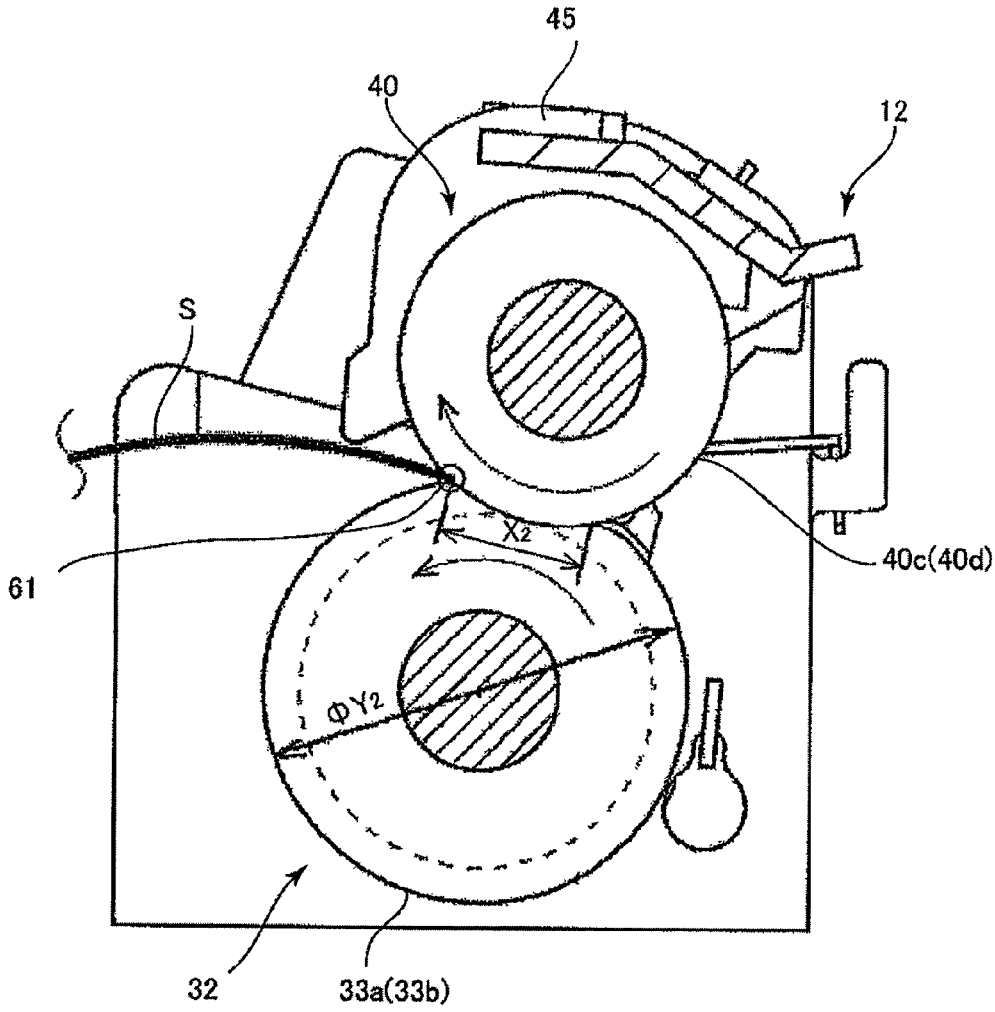
FIG. 6 is a view illustrating a state that the rear end of a sheet passes through the center of the pair of registration rollers.

FIG. 6 shows a state when the sheet S passes through a nip between the first and second registration roller rubbers 33*a* and 33*b* located at the center of the registration roller 32 and the third and fourth registration driven rollers 40*c* and 40*d*. In FIG. 6, X2 represents the width in the sheet conveying direction of nips between the first and second registration roller rubbers 33*a* and 33*b* and the third and fourth registration driven rollers 40*c* and 40*d*. Namely, the width X2 is a nip width of a plurality of the pair of rollers, including the first and second registration roller rubbers 33*a* and 33*b* and the third and fourth registration driven rollers 40*c* and 40*d*. The sheet S passes through a nip pass-through portion 61. Y2 represents the outer diameters of the first and second registration roller rubbers 33*a* and 33*b*. In the present embodiment, the first and second registration roller rubbers 33*a* and 33*b* are formed of rubber with a low hardness, and the hardness Z2 is set to approximately 40° to 60°.

In the present embodiment, the outer diameter Y1 and the hardness Z1 of the third to sixth registration roller rubbers 32*a* to 32*d* and the outer diameter Y2 and the hardness Z2 of the first and second registration roller rubbers 33*a* and 33*b* are set to have relations of Y1<Y2 and Z1>Z2. Consequently, the relation between the nip width X1 of the third to sixth registration roller rubbers 32*a* to 32*d* and the registration driven rollers 40*a*, 40*b*, 40*e*, and 40*f* and the nip width X2 of the first and second registration roller rubbers 33*a* and 33*b* and the registration driven rollers 40*c* and 40*d* is X1<X2. Namely, such a setting is performed that the nip width of the pair of rollers located on the center side is larger than the nip width of the pair of rollers located on the respective outer sides.

At the moment when the sheet passes through the nip between the registration roller 32 and the registration driven roller 40, the acceleration occurs in the sheet due to a conveying velocity difference and the thickness of the sheet, as described above, and a deviation of the pitch of the latent image at the irradiated portion 58 (see, FIG. 4B) and a transfer blur in the transfer portion 7A may occur. However, the relation between the nip widths X1 and X2 is X1<X2, whereby when the both ends of the rear end of the sheet S pass through the nip X1, as shown in FIG. 5, the center of the rear end remains nipped by the first and second registration roller rubbers 33*a* and 33*b* and the registration driven rollers 40*c* and 40*d*. Thereafter, by virtue of the rotation of the registration roller 32, the sheet passes through the nip between the first and second registration roller rubbers 33*a* and 33*b* provided on the center side and the registration driven rollers 40*c* and 40*d*.

At that time, since the first and second registration roller rubbers 33*a* and 33*b* are set to have a low hardness, a variation of the velocity of the sheet that occurs when the sheet passes through a nip is reduced. Thus, the sheet velocity variation (acceleration) that easily occurs when the sheet passes through the nip between the registration roller 32 including a roller rubber with high hardness and the registration driven roller 40 can be mitigated. The mitigation of the variation of the sheet conveying velocity that occurs when the sheet passes through the nip of the registration roller can suppress the variation of the velocity of the photosensitive drum and reduce blurring of the pitch of an image.

As described above, the nip width in the sheet conveying direction is X1<X2, whereby when the sheet passes through the pair of registration rollers 12, the magnitude of the acceleration applied to the sheet can be reduced. This constitution can suppress the variation of the sheet conveying velocity that occurs when the sheet passes through the pair of sheet conveying rollers. In the present embodiment, as described above, the first and second registration roller rubbers 33*a* and 33*b* located at the center in the width direction of the sheet have a large diameter and a low hardness. According to this constitution, the number of nips by the registration roller rubber 32 (the number of regions where the sheet is nipped) is changed corresponding to the sheet width, and the above effects can be applied to the sheet width in the range that the nip by the registration roller rubber 33 is always formed. Therefore, it is possible to correspond to sheets having various sizes, such as an ordinary used postcard, an A4 sheet, and an LTR size sheet.

In the present embodiment, the nip width X1 of the third to sixth registration roller rubbers 32*a* to 32*d* and the registration driven rollers 40*a*, 40*b*, 40*e*, and 40*f* and the nip width X2 of the first and second registration roller rubbers 33*a* and 33*b* and the registration driven rollers 40*c* and 40*d* have the relation of X1<X2; however, they may have the opposite relation. Namely, the nip width X1 of the third to sixth registration roller rubbers 32*a* to 32*d* and the registration driven rollers 40*a*, 40*b*, 40*e*, and 40*f* and the nip width X2 of the first and second registration roller rubbers 33*a* and 33*b* and the registration driven rollers 40*c* and 40*d* can have the relation of X2<X1. The relation can also provide the same effects.

Figure 7:
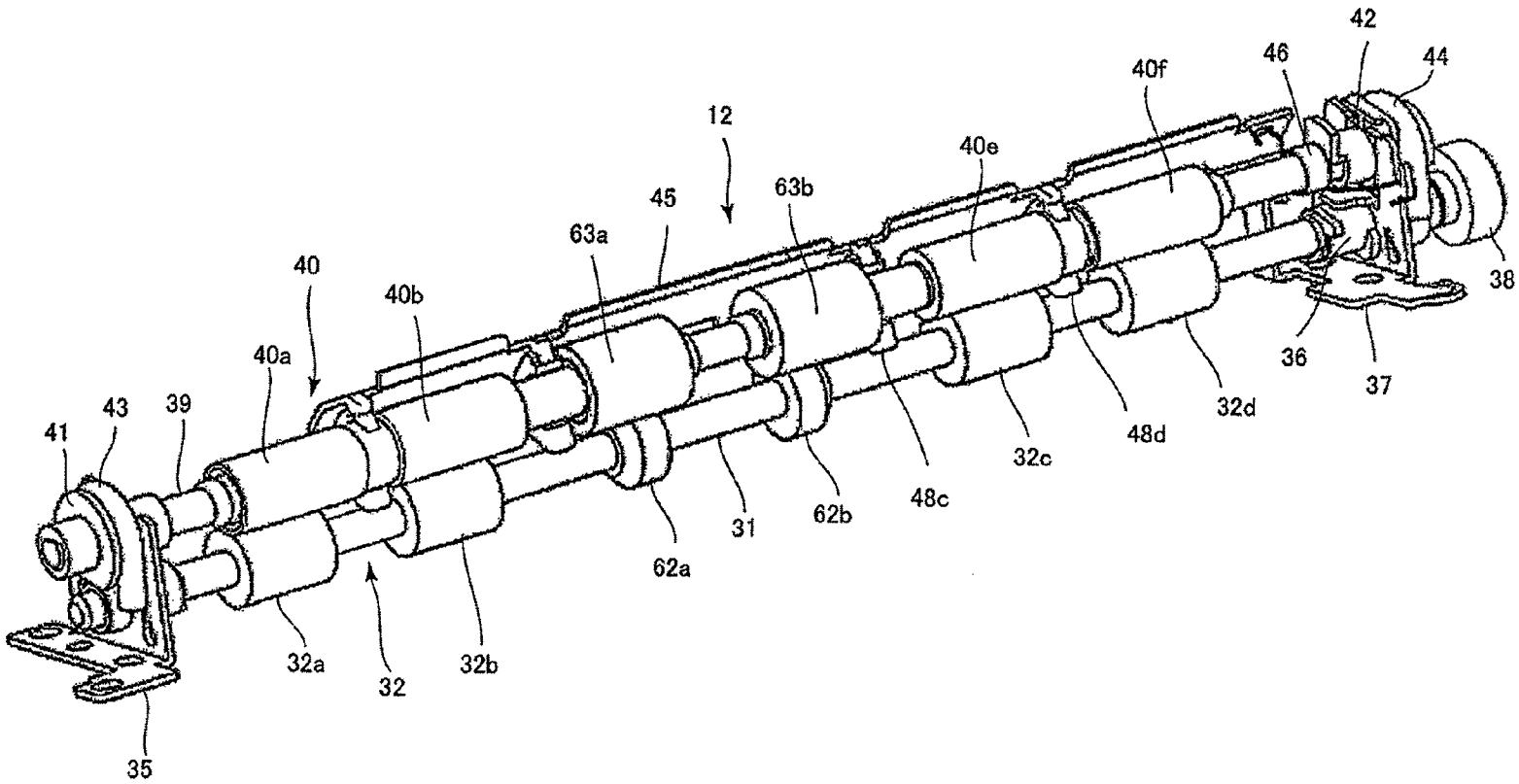
FIG. 7 is a perspective view of a pair of registration rollers including a registration portion provided in an image forming apparatus according to a second embodiment of the present invention.

Next, a second embodiment of the present invention will be described. FIG. 7 is a perspective view of a registration roller pair including a registration portion of an image forming apparatus according to the second embodiment. In the second embodiment, the constitution different from that of the first embodiment will be described in detail, and the description of the same constitution as that of the first embodiment will be omitted. In FIG. 7, the same reference numerals as those of FIG. 2 denote the same or corresponding components. In FIG. 7, the registration roller 32 includes first and second registration roller rubbers 62*a* and 62*b* which are fixed to the registration roller shaft 31 so as to be provided separately from the center of the registration roller shaft 31 to the left and right sides of the registration roller shaft 31. The registration driven roller 40 includes third and fourth tubular driven rollers 63*a* and 63*b* rotatably held by the roller shaft 39, and the third and fourth tubular driven rollers 63*a* and 63*b* are in press contact with the first and second registration roller rubbers 62*a* and 62*b*.

Figure 8:
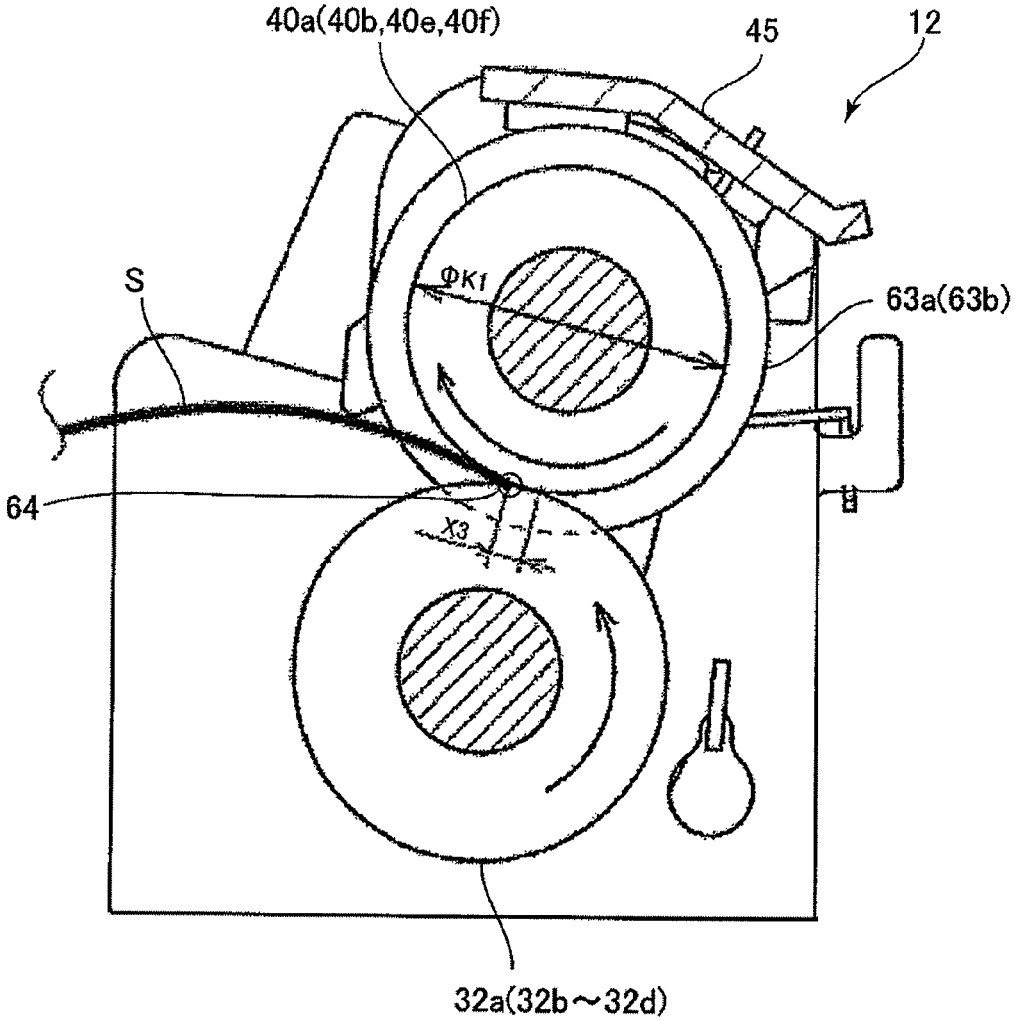
FIG. 8 is a view illustrating a state that the rear end of a sheet passes through the end side of the pair of registration rollers.

FIG. 8 shows a state that the rear end of the sheet S, which has reached the transfer portion, passes through the nip between the registration roller 32 and the registration driven roller 40. In FIG. 8, the registration roller 32 rotates in the counter clockwise direction, and the registration driven roller 40 in press contact with the registration roller 32 rotates in the clockwise direction in accordance with the rotation of the registration roller 32. By virtue of the conveyance of the sheet S, the registration shutter 45 is in a state of being pushed up in the clockwise direction. In FIG. 8, X3 represents a width in the sheet conveying direction of nips formed between the third to sixth registration roller rubbers 32*a* to 32*d* of the registration roller 32 and the first, second, fifth, and sixth registration driven rollers 40*a*, 40*b*, 40*e*, and 40*f*. The sheet S passes through a nip pass-through portion 64. K1 represents the outer diameters of the first, second, fifth, and sixth registration driven rollers 40*a*, 40*b*, 40*e*, and 40*f*. The third to sixth registration roller rubbers 32*a* to 32*d* are formed of hard rubber for stable conveyance purposes, and the hardness Z1 is set to approximately 80° to 90°.

Figure 9:
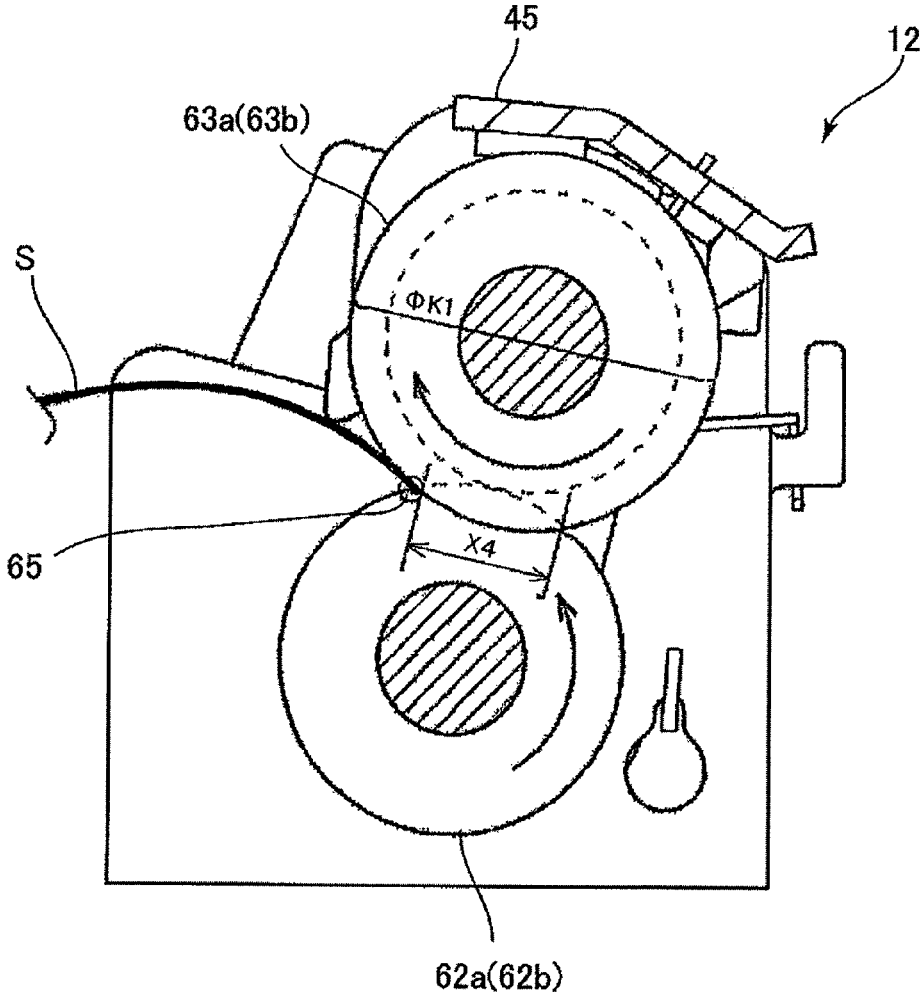
FIG. 9 is a view illustrating a state that the rear end of a sheet passes through the center of the pair of registration rollers.

FIG. 9 shows a state when the sheet S passes through a nip between the first and second registration roller rubbers 62*a* and 62*b* provided separately from the center of the registration roller 32 to the left and right sides of the registration roller 32 and the third and fourth driven rollers 63*a* and 63*b*. In FIG. 9, X4 represents a width in the sheet conveying direction of nips between the first and second registration roller rubbers 62*a* and 62*b* and the third and fourth driven rollers 63*a* and 63*b*. The sheet S passes through a nip pass-through portion 65. K2 represents the outer diameters of the third and fourth driven rollers 63*a* and 63*b*. The first and second registration roller rubbers 62*a* and 62*b* are formed of rubber with a low hardness, and the hardness Z2 is set to approximately 40° to 60°.

In the present embodiment, the outer diameter K1 of the first, second, fifth, and sixth registration driven rollers 40*a*, 40*b*, 40*e*, and 40*f* and the outer diameter K2 of the third and fourth driven rollers 63*a* and 63*b* are set to have a relation of K1<K2. The hardness Z1 of the third to sixth registration roller rubbers 32*a* to 32*d* and the hardness Z2 of the first and second registration roller rubbers 62*a* and 62*b* are set to have a relation of Z1>Z2. Consequently, the relation between the nip width X3 of the third to sixth registration roller rubbers 32*a* to 32*d* and the registration driven rollers 40*a*, 40*b*, 40*e*, and 40*f* and the nip width X4 of the first and second registration roller rubbers 62*a* and 62*b* and the third and fourth driven rollers 63*a* and 63*b* is X3<X4. Namely, such a setting is performed that the nip width of the pair of rollers located on the center side is larger than the nip width of the pair of rollers located on the respective outer sides.

The relation between the nip widths X3 and X4 is X3<X4, whereby when the both ends of the rear end of the sheet S pass through the nip X3, as shown in FIG. 8, the center of the rear end remains nipped by the first and second registration roller rubbers 62*a* and 62*b* and the registration driven rollers 63*a* and 63*b*. Thereafter, by virtue of the rotation of the registration roller 32, the sheet passes through the nips between the first and second registration roller rubbers 62*a* and 62*b* provided on the center side and the registration driven rollers 63*a* and 63*b* at the nip pass-through portion 65. Thus, it is possible to mitigate the sheet velocity variation (acceleration) that easily occurs when the sheet passes through the nip between the registration roller 32, including a rubber roller with high hardness, and the registration driven roller 40.

At that time, since the first and second registration roller rubbers 62*a* and 62*b* are set to have a low hardness, the sheet velocity variation that occurs when the sheet passes through a nip is reduced. Thus, it is possible to mitigate the sheet velocity variation (acceleration) that easily occurs when the sheet passes through the nip between the registration roller 32, including roller rubber with a high hardness, and the registration driven roller 40. The variation of the sheet conveying velocity that occurs when the sheet passes through the nip of the registration roller is mitigated, whereby it is possible to suppress the variation of the velocity of the photosensitive drum and reduce blurring of the pitch of an image.

According to this constitution, although the first and second registration roller rubbers 62*a* and 62*b* and the third to sixth registration roller rubbers 32*a* to 32*d* are different in hardness and shape in the width direction, the outer diameters can be set to be substantially the same. Therefore, in the production of a rubber roller, a polishing process performed when the outer diameter is formed is facilitated. In the present embodiment, as in the first embodiment, the first and second registration roller rubbers 62*a* and 62*b* are disposed at the center in the axial direction of the registration roller shaft 31. According to this constitution, only the number of nips by the registration roller 32 (the number of regions where the sheet is nipped) is changed corresponding to the sheet width, and the above effects can be applied to the sheet width in the range that the nip by the registration roller rubber 62 is always formed. Therefore, it is possible to correspond to sheets having various sizes, such as an ordinary used postcard, an A4 sheet, and an LTR size sheet.

Figure 10:
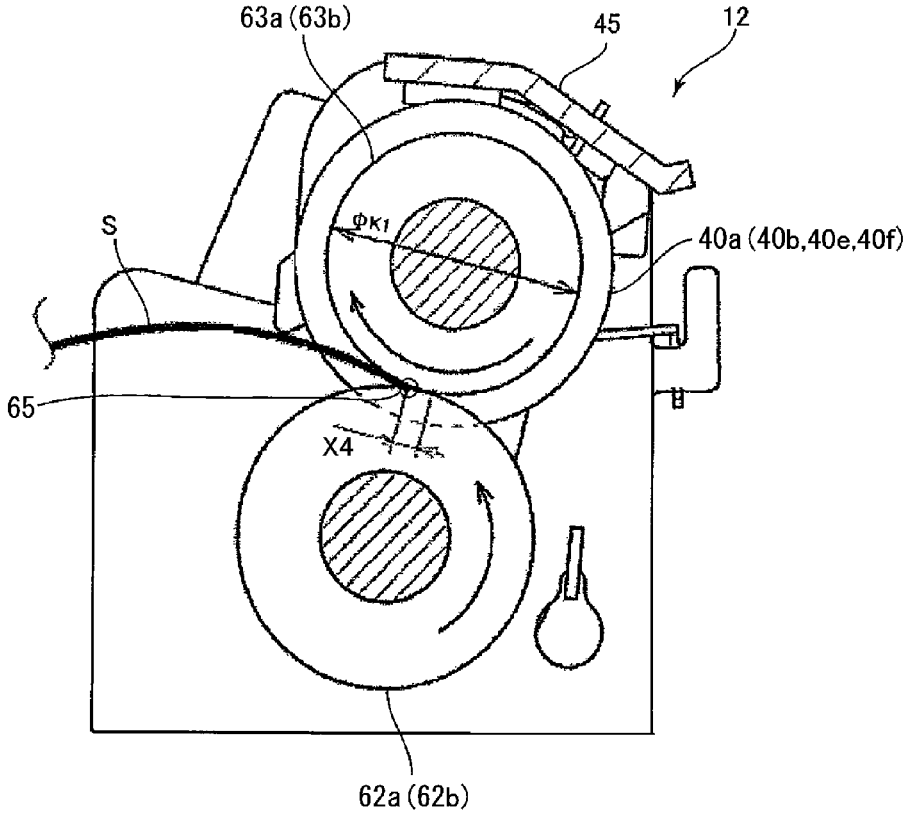
FIG. 10 is a view illustrating another embodiment of a state that the rear end of the sheet passes through the center of the pair of registration rollers.
Figure 11:
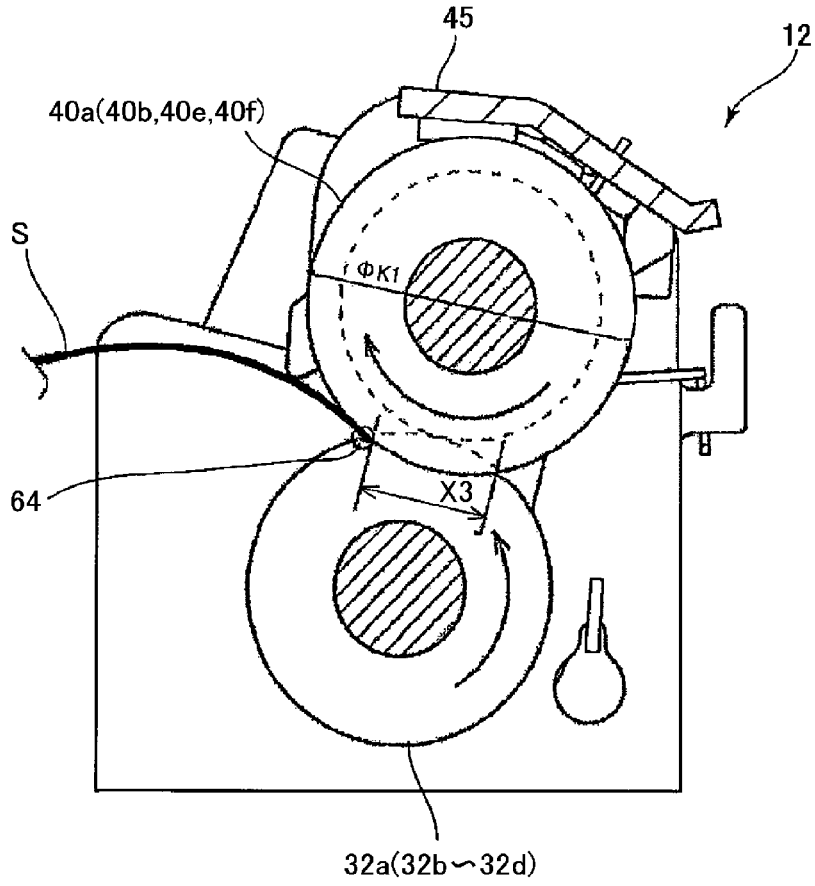
FIG. 11 is a view illustrating another embodiment of a state that the rear end of the sheet passes through the end side of the pair of registration rollers.

Also in the second embodiment, as in the first embodiment, even if the relation between the nip widths X3 and X4 (X3<X4) is opposite, that is, X4<X3, the same effects can be provided as in the first embodiment as shown in FIG. 10 and FIG. 11.

In the above description, the pair of registration rollers is used as the sheet conveying portion; however, the present invention is not limited thereto. For example, the present invention may be applied to the pair of conveying rollers 11 located on the upstream side in the sheet conveying direction of the pair of registration rollers. According to this constitution, it is possible to mitigate unevenness of the conveying velocity that occurs when a sheet passes through the nip between the pair of registration rollers 12 and the nip between the pair of conveying rollers 11. Consequently, the conveyance in the registration roller, which feeds a sheet to the image forming portion is stabilized, and image unevenness due to the conveying roller can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-130469, filed May 29, 2009, which is hereby incorporated by reference herein in its entirety.

What is claimed is:

1. An image forming apparatus comprising:

a pair of sheet conveying rollers which conveys a sheet to an image forming portion which forms an image on the sheet, wherein the pair of sheet conveying rollers includes a driving roller including a roller shaft and first and second roller portions which are disposed on the roller shaft in an axial direction symmetrically with respect to a center in a width direction crosswise to a sheet conveying direction, and a driven roller including first and second driven roller portions which are disposed in the axial direction, which respectively press contact with the first and second roller portions, wherein the first driven roller portion in press contact with the first roller portion and the second driven roller portion in press contact with the second roller portion, a length along the sheet conveying direction of a press contact portion between the first roller portion and the first driven roller portion is larger than a length along the sheet conveying direction of a press contact portion between the second roller portion and the second driven roller portion.

2. The image forming apparatus according to claim 1, wherein an outer diameter of the first roller portion is larger than an outer diameter of the second roller portion, and hardness of the first roller portion is smaller than hardness of the second roller portion.

3. The image forming apparatus according to claim 1, wherein the hardness of the first roller portion is smaller than the hardness of the second roller portion, and an outer diameter of the first driven roller portion is larger than an outer diameter of the second driven roller portion.

4. The image forming apparatus according to claim 1, further comprising a skew feeding correction member which is biased by a biasing unit in the direction opposite to the sheet conveying direction, is abutted against a sheet traveling toward the pair of sheet conveying rollers upstream in the sheet conveying direction of the pair of sheet conveying rollers to correct skew feeding of the sheet, and is pressed by the sheet after the skew feeding correction to swing against the biasing force of the biasing unit.

5. The image forming apparatus according to claim 1, wherein the length along the sheet conveying direction of the press contact portion between the first roller portion and the first driven roller portion located on the center side in the roller shaft is larger than the length along the sheet conveying direction of the press contact portion between the second roller portion and the second driven roller portion located on a outer side.

6. The image forming apparatus according to claim 1, wherein the length along the sheet conveying direction of the press contact portion between the first roller portion and the first driven roller portion located on an outer side in the roller shaft is larger than the length along the sheet conveying direction of the press contact portion between the second roller portion and the second driven roller portion located on the center side.

* * * * *